US008141757B2

(12) United States Patent
Headley

(10) Patent No.: US 8,141,757 B2
(45) Date of Patent: Mar. 27, 2012

(54) BELT CONVERTIBLE TO BACKPACK

(76) Inventor: George M. Headley, Miami, FL (US)

( * ) Notice: Subject to any disclaimer, the term of this patent is extended or adjusted under 35 U.S.C. 154(b) by 1351 days.

(21) Appl. No.: 11/469,658

(22) Filed: Sep. 1, 2006

(65) Prior Publication Data

US 2008/0054031 A1 Mar. 6, 2008

(51) Int. Cl.
*A45F 4/02* (2006.01)

(52) U.S. Cl. ..... 224/153; 224/581; 224/627

(58) Field of Classification Search ..... 224/153, 224/578, 603, 627, 656, 257, 620, 645, 660, 224/676, 577, 579–583; 2/338; 383/4
See application file for complete search history.

(56) References Cited

U.S. PATENT DOCUMENTS 5,797,529 A * 8/1998 Lavine ..... 224/575
5,988,474 A * 11/1999 Smith et al. ..... 224/578
2008/0190980 A1 * 8/2008 Overton ..... 224/664
* cited by examiner

*Primary Examiner* — Justin Larson
*Assistant Examiner* — Corey Skurdal
(74) *Attorney, Agent, or Firm* — Robert C. Kain, Jr.

(57) ABSTRACT

The belt, convertible to a backpack, is worn about the waist of a person and includes an elongated strap, free end sections and a belt latch. The belt-backpack also includes a sack attached to the strap mid-section. The sack has an opening to permit access to its interior and a closure system (zipper, velcro, etc.,) for closing the sack opening. A pair of elongated extension panels is longitudinally affixed to an outer surface of the sack and each panel has an opposing free side edge. Each opposing free side edge has a complimentary closing system (preferably zipper) such that the extension panels and the strap form a pouch within which is disposed the folded sack and, in an opened condition, the sack is unfolded to expose the closable opening of the sack. The free end sections form backpack straps which permits the user to carry the sack.

4 Claims, 5 Drawing Sheets

BELT CONVERTIBLE TO BACKPACK

The present invention relates to a belt, adapted to be worn around the waist of a person, which is convertible into a backpack.

BACKGROUND OF THE INVENTION

When persons are traveling, there is sometimes a need to provide a compact article which can be easily carried by the person. Belts or straps which wrap around the waist of a person accomplish this objective, that is, carrying the article. Furthermore, it is sometimes necessary for that same traveling person to use a sack or a backpack which can carry items therein. The sack or backpack, as those terms are used herein, include foldable bags, sacks or pouches which have a shoulder strap such that the person can carry the sack, pouch or pack on his or her shoulder.

OBJECTS OF THE INVENTION

It is an object of the present invention to provide a single article of clothing which, in one mode of operation, is a strap adapted to be worn about the waist of a person, and, in a second mode of operation, is a sack which is configured as a backpack to be carried by that person on his or her shoulder.

It is another object of the present invention to provide a belt, convertible to a backpack, having an elongated strap, and a sack which is foldable by multiple folds into a width not exceeding the width of the strap.

It is a further object of the present invention to provide a belt, convertible to a backpack, which includes a hideaway strap pouch when the system, in one embodiment, is configured as a strap worn about the waist of a person.

SUMMARY OF THE INVENTION

The belt, convertible to a backpack, is worn about the waist of a person. The convertible backpack-belt includes an elongated strap having opposing free end sections and a mid-section. A belt latch on the opposing free end sections enables the strap to be worn on the waist in an encircling mode or manner. The belt-backpack also includes a sack having a lateral expanse at least three times greater than the width of the strap and having an opening to permit access into the interior of the sack and a closure system (zipper, velcro, etc.,) for closing the sack opening. The belt-backpack includes a pair of elongated extension panels longitudinally affixed to one of the outer generally planar surfaces of the sack. These extension panels have one attached elongated side edge and an opposing free side edge. The combined width of the panels is not greater than the width of the strap. Each opposing free side edge has a complimentary closing system (preferably zipper) such that the extension panels and the strap form a pouch within which is disposed the sack in a folded condition and, in an opened condition, the sack is unfolded to expose the closure system for the sack. The free end sections form backpack straps which permits the user to carry the sack on his or her shoulders.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a belt which is convertible into a backpack.

Figure 1:
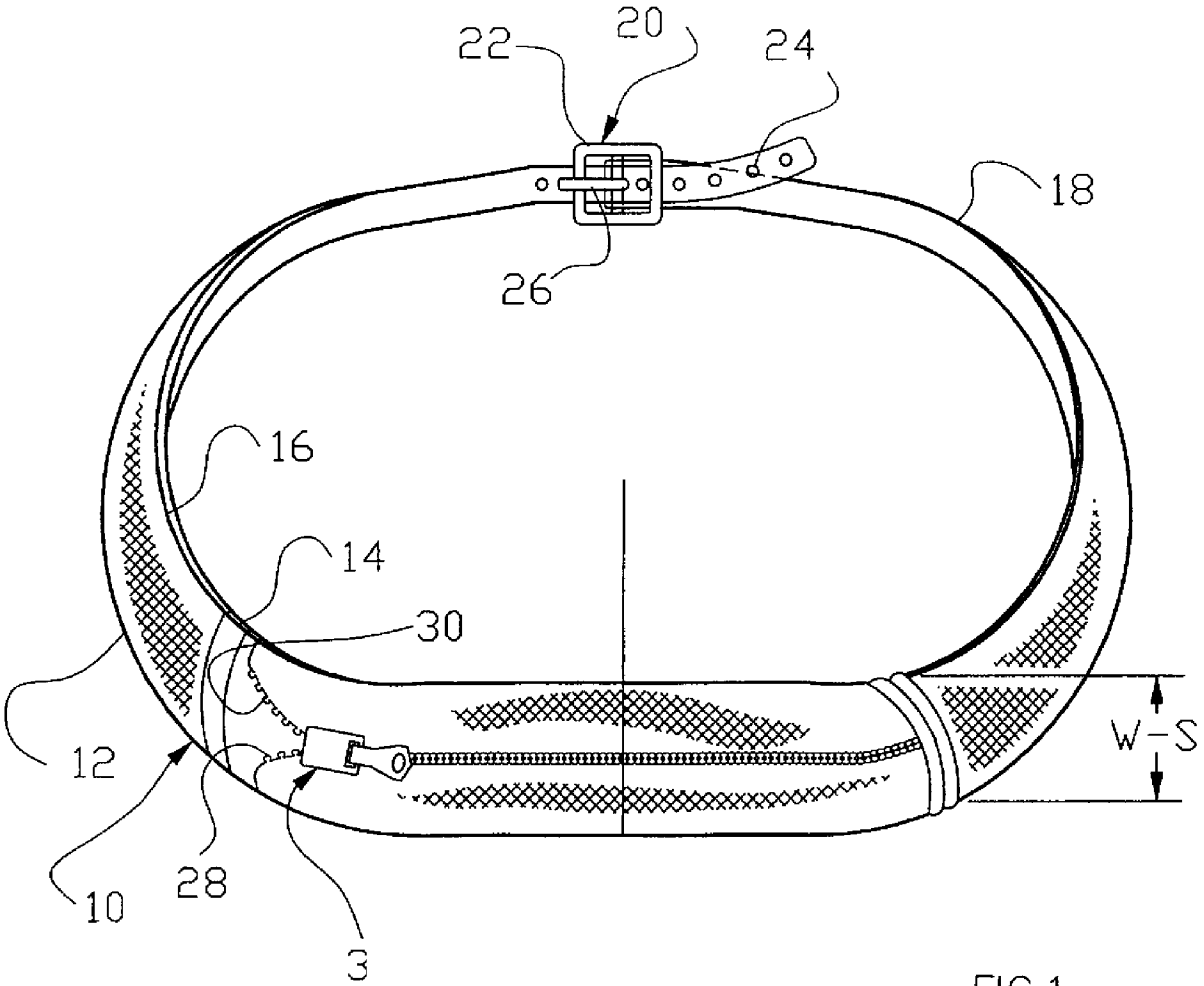
FIG. 1 diagrammatically illustrates the convertible backpack-belt configured as a belt.

FIG. 1 diagrammatically illustrates the convertible belt-backpack 10 in a closed, waist encircling mode wherein the elongated extension panels are in a closed, sack encircling mode which forms a pouch within which is disposed the folded sack (not shown). Similar numerals designate similar items throughout all the drawings. Convertible article 10 includes an elongated strap 12 having a width W-S sized to wrap around the waist of the person. Strap 12 has a mid-section 14 leading to two opposing free end sections 16, 18. The length of the mid-section 14 and the length of each of the free end sections 16, 18, when combined, are sized to wrap around the waist of a person. Each opposing free end section 16, 18 includes a complimentary unit of a detachable belt latch. In the illustrated embodiment, the belt latch 20 includes a belt buckle 22 attached to free end section 18 and a series of holes, one of which is hole 24, which is complimentary to clasp 26 of belt latch 20. Of course, other types of belt latches could be utilized such as a tie off, velcro, buttons and button holes, complimentary units of a snap system and toggle bars and loops. These items are included in the meaning of a "detachable belt latch". The strap has two modes of operation, in FIG. 1, the strap is in a closed, waist encircling mode. In the remaining figures, the strap is shown in a free, open ended mode wherein free end sections 16, 18 are not coupled together by detachable belt latch 20.

A sack is generally disposed opposite the free end sections and detachable belt latch 20 which sack, in FIG. 1, is in a completely folded configuration. Elongated extension panels 28, 30 have a detachable edge closure system 32 which is shown in the closed mode. Closure system 32 in the illustrated embodiment, is a zipper. However, the closure system may be any type of detachable closure including velcro, snaps, buttons and button holes, toggle bars operable with loops or button holes, or other similar detachable closure mechanisms.

Figure 2:
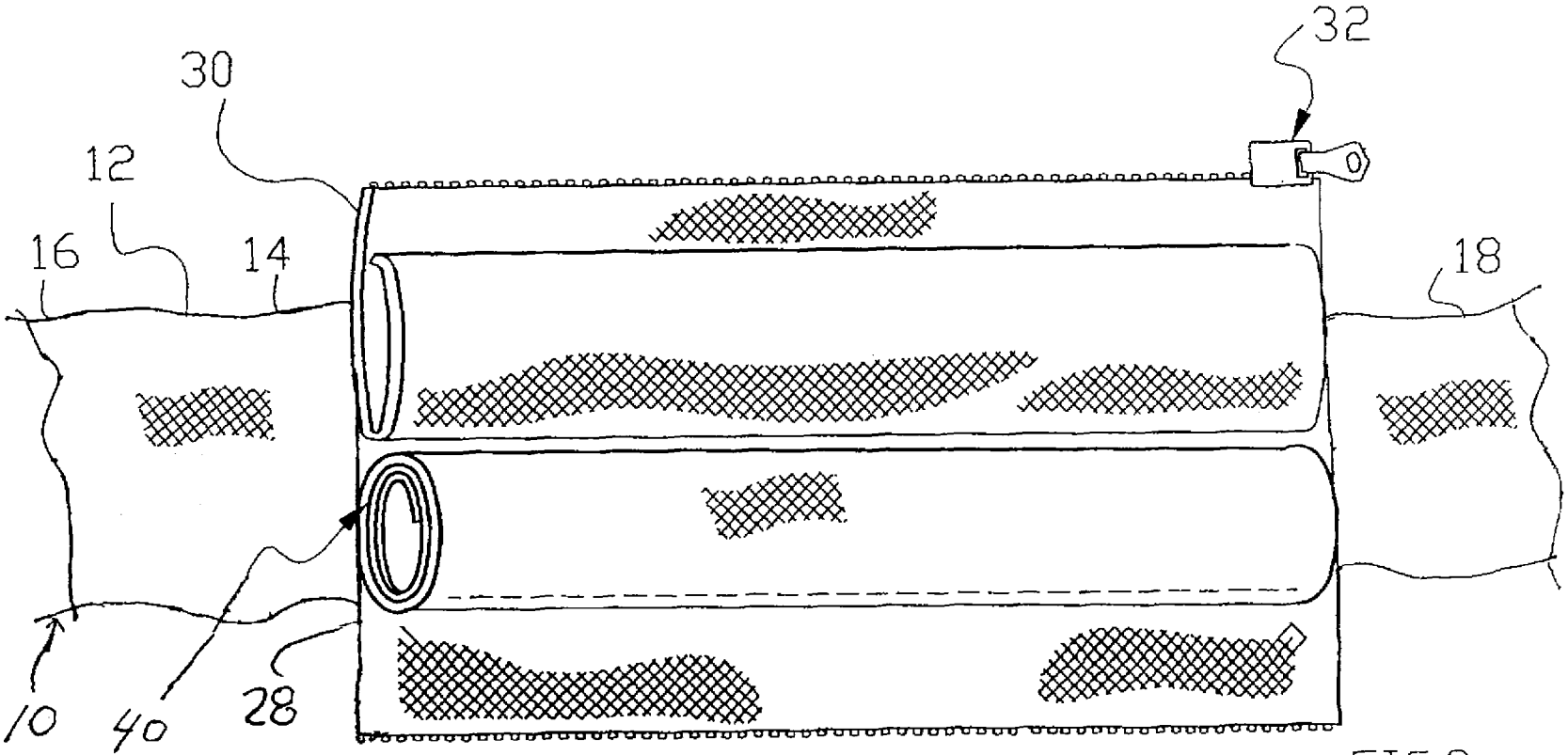
FIG. 2 diagrammatically illustrates the convertible article wherein the sack is partially unfolded.

FIG. 2 shows the sack 40 in a partially unfolded configuration. The detachable edge closure system 32 has been fully opened in an opened, completely edge detached mode. Sack 40 has a length not exceeding, in general terms, the mid-section 14 of the strap.

Figure 3:
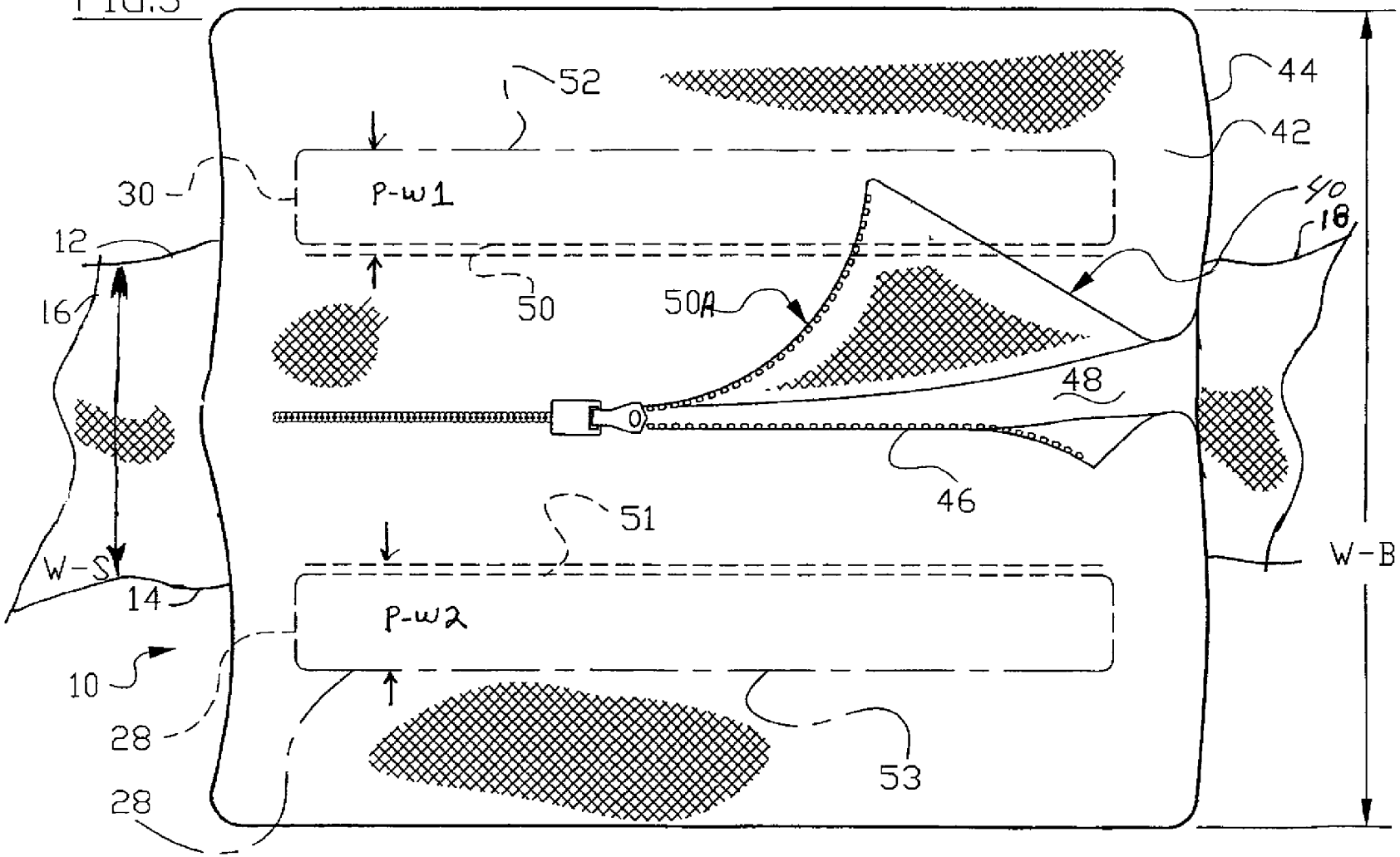
FIG. 3 diagrammatically illustrates one embodiment of a convertible belt-backpack wherein the sack is fully unfolded and the sack opening is partially opened and the elongated extension panels are disposed on the opposite side of the sack.

FIG. 3 shows that sack 40 has been completely unfolded. The sack has a lateral expense W-B (backpack width) which is, in general, at least three times greater than the width W-S of strap 12. In the preferred embodiment, the lateral expanse W-B of sack 40 is a foldable multiple of the width W-S of the strap. For example, FIG. 3 shows that the lateral expanse W-B is about a multiple of 12 of the strap width. Sack 40 includes a first side 42 and an opposite side 44. Side 42 defines a sack opening 46. The sack opening permits access to the interior space 48 of the sack. The sack opening also includes a closure system 50A which permits the user to open and close sack 40. As shown in FIG. 3, a zipper closure system or means is shown. However, other closure systems discussed above (see system 32) may be employed. The pair of elongated extension panels 28, 30 are attached to the opposite side 44 of sack 40. These extension panels 28, 30 are longitudinally affixed along one long edge to the outer surface 44 of sack 40. Each extension panel 30, 28 has one attached elongated side edge 50, 51 and an opposing free side edge 52, 53. As discussed above in connection with FIG. 1, the opposing free side edges 52, 53 carry complementary units of an elongated detachable edge closure means discussed earlier in connection with FIGS. 1 and 2. The combined width P-W1, P-W2 of the extension panels 28, 30 is not greater than the width of the strap. The attached elongated side edges 50, 51 of each panel 30, 28 being spaced apart on said sack a distance substantially equivalent to said width W-S of said strap.

Figure 4:
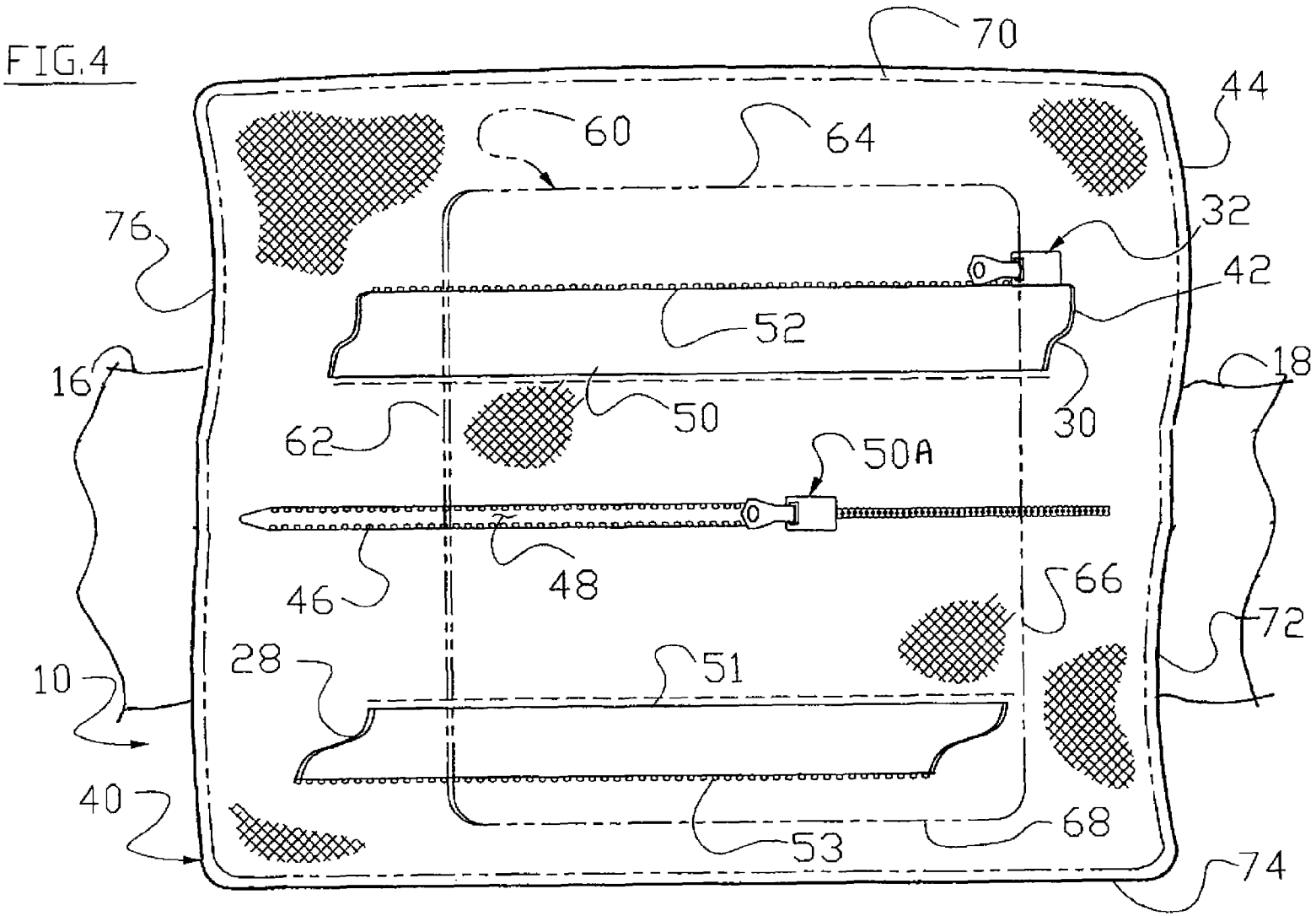
FIG. 4 diagrammatically illustrates another embodiment of the convertible belt-backpack wherein the elongated extension panels are attached to the side of the sack which also defines the sack opening (and shows an interior pouch)

FIG. 4 diagrammatically illustrates another embodiment. In this embodiment, the sack has an exposed side 44 and a body adjacent side 42. Elongated extension panels 28, 30 are attached to the body adjacent side 42 of sack 40. The sack opening 46 is defined on the body adjacent side 42. A closure system 50A enables the user to open and close opening 46 of sack 40 on the body adjacent side 42. In addition, the interior space 48 of sack 40 includes a secondary pouch 60 shown by the dash-dot-dot-dash lines. The secondary pouch 60 formed in the interior space 48 of sack 40 includes an opening 62 shown by the double lines dash-dot-dot-dash. Interior pouch 60 is attached to the inside of sack 40 along sides 64, 66 and 68. Sack 40 includes four side edges 70, 72, 74 and 76 (each sack side 42, 44 has four edges) that form a seam between body adjacent side 42 and exposed side 44.

Figure 5:
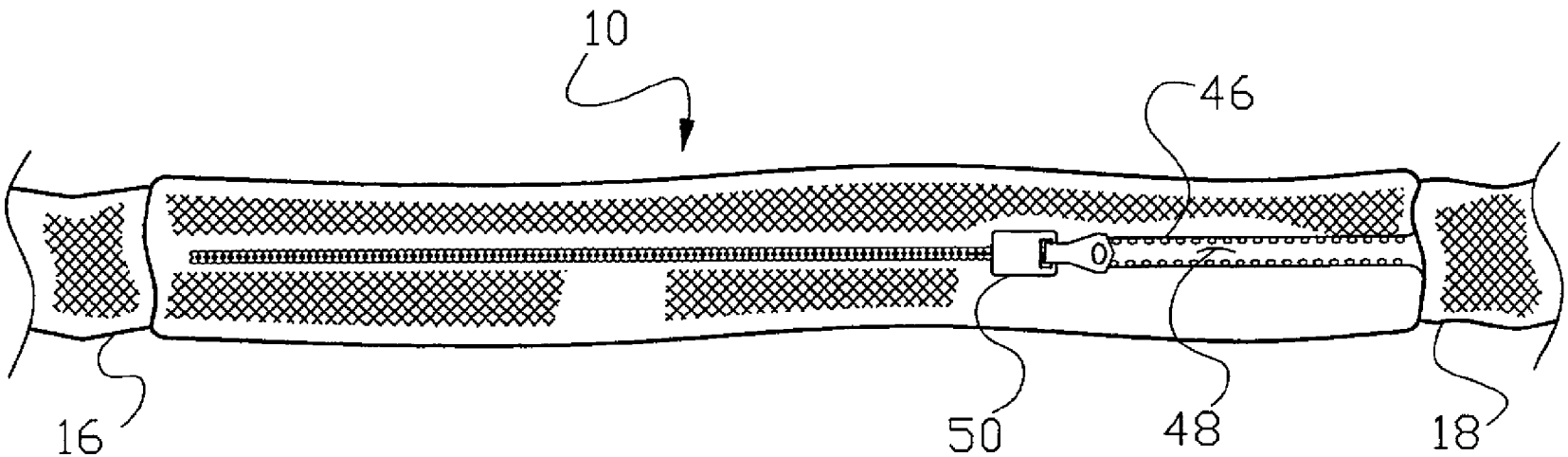
FIG. 5 diagrammatically illustrates the convertible belt-backpack in the closed, sack encircling mode showing a hideaway strap pouch for the person.

FIG. 5 shows convertible article 10 wherein the sack, shown in FIG. 4, has been completely folded and closure system 50A for sack 40 is partially opened. Effectively, the sack is rolled or folded in a direction such that exposed sack side 44 (FIG. 4) portions are adjacent each other and the side extension panels 28, 30 (FIG. 4) are joined together such that panel closure system 32 forms a pouch under panels and encloses the folded sack. The closure system 32 of the elongated extension panels 28, 30, are not shown in FIG. 5 since they are on the opposite side of the body adjacent, illustrated side of the convertible article 10. In this embodiment, the closure system 50A for the sack also is a hideaway strap pouch 48. Persons can open and close closure system 50A and store items therein.

In the sack unfolded condition FIGS. 3-4, items are to be placed in the interior of the sack, the sack closure system 50A closed, the belt latch 20 (FIG. 1) closed and the article 10 carried on the shoulder of a user.

The claims appended hereto are meant to cover modifications and changes within the scope and spirit of the present invention.

What is claimed is:

1. A belt, adapted to be worn about the waist of a person, convertible to a backpack comprising:

an elongated strap having a width and a length sized to wrap around said waist of said person, said strap having an elongated mid-section leading to opposing free end sections and each opposing free end section having a complementary unit of a detachable belt latch such that said strap and detachable belt latch have a closed, waist encircling mode and an open, free end mode;

a sack having a length not exceeding said mid-section of said strap and a lateral expanse at least three times greater than said width of said strap, said sack having an opening permitting access to an interior space of said sack, said sack having a means for closing said opening disposed thereat; and a pair of elongated extension panels longitudinally affixed to an outer surface of said sack, each panel having a panel width, each panel having a longitudinal attached side edge attached to the sack and an opposing free side edge spaced from the attached side edge by the panel width, said panels having a combined panel width not greater than said strap width, said attached elongated side edges of each panel spaced apart on said sack a distance substantially equivalent to said width of said strap, and each opposing free side edge having a complementary unit of an elongated detachable edge closure means such that said pair of elongated extension panels and said mid-section of said strap and said elongated detachable edge closure means have a closed, sack encircling mode which forms a pouch within which is disposed said sack in a folded condition, and an open, completely edge detached mode wherein said sack is unfolded to expose said means for closing said sack.

2. A belt convertible to a backpack as claimed in claim 1 wherein said sack opening is a longitudinal opening spanning less than the mid-section of said strap, said sack opening being axially aligned with said mid-section of said strap.

3. A belt convertible to a backpack as claimed in claim 1 wherein said lateral expanse of said sack is a foldable multiple of said width of said strap.

4. A belt convertible to a backpack as claimed in claim 1 wherein said sack has an exposed side and a body adjacent side, the edges of said exposed sack side and said body adjacent sack side affixed to each other, said sack opening is a longitudinal opening spanning less than the mid-section of said strap and defined at said body adjacent sack side, said sack opening being axially aligned with said mid-section of said strap, said pair of elongated extension panels affixed to said body adjacent sack side, wherein, in said closed, sack encircling mode, said elongated detachable edge closure means captures said sack in said folded condition, and said means for closing said sack opening defines a hide-away strap pouch for said person when said strap and said detachable belt latch are in said closed, waist encircling mode.

* * * * *